US011302236B2

(12) United States Patent
Pyun et al.

(10) Patent No.: US 11,302,236 B2
(45) Date of Patent: Apr. 12, 2022

(54) DISPLAY DEVICE AND METHOD FOR DRIVING THE SAME

(71) Applicant: SAMSUNG DISPLAY CO., LTD., Yongin-si (KR)

(72) Inventors: Ki Hyun Pyun, Yongin-si (KR); Min Young Park, Yongin-si (KR); Eun Jin Choi, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/235,202

(22) Filed: Apr. 20, 2021

(65) Prior Publication Data

US 2022/0084453 A1 Mar. 17, 2022

(30) Foreign Application Priority Data

Sep. 14, 2020 (KR) ..... 10-2020-0117971

(51) Int. Cl.
*G09G 3/20* (2006.01)

(52) U.S. Cl.
CPC ..... *G09G 3/2003* (2013.01); *G09G 2310/027* (2013.01); *G09G 2310/0286* (2013.01); *G09G 2310/0291* (2013.01); *G09G 2310/08* (2013.01)

(58) Field of Classification Search
CPC ..... G09G 3/2003; G09G 2310/0291; G09G 2310/08; G09G 2310/0286; G09G 2310/027
See application file for complete search history.

(56) References Cited

U.S. PATENT DOCUMENTS

| | | | | |
|---|---|---|---|---|
| 9,626,912 | B2 | 4/2017 | Kim et al. | |
| 9,691,341 | B2 | 6/2017 | Ahn et al. | |
| 10,810,943 | B2 | 10/2020 | Yum et al. | |
| 2006/0038764 | A1 * | 2/2006 | Takahashi | G09G 3/3688 345/100 |
| 2014/0118410 | A1 | 5/2014 | Oh | |
| 2015/0213770 | A1 * | 7/2015 | Baek | G09G 3/3688 345/691 |

FOREIGN PATENT DOCUMENTS

| | | | |
|---|---|---|---|
| KR | 1020160038194 | A | 4/2016 |
| KR | 1020160093153 | A | 8/2016 |
| KR | 101990111 | B1 | 6/2019 |
| KR | 1020190127472 | A | 11/2019 |

* cited by examiner

*Primary Examiner* — Andrew Sasinowski
(74) *Attorney, Agent, or Firm* — Cantor Colburn LLP

(57) ABSTRACT

A display device includes: a pixel unit including pixels connected to data lines and scan lines, and signal output lines, where at least one signal output line of the signal output lines is connected to each of the scan lines through a contact point; a data driver disposed at one side of the pixel unit to drive the data lines; a scan driver disposed at the one side of the pixel unit together with the data driver to drive the scan lines; and a timing controller controlling the data driver and the scan driver. The data driver includes: output buffers outputting data signals to the data lines, respectively; and a slew rate controller adjusting a slew rate of the data signals by controlling a bias value supplied to the output buffers in units of pixel rows based on positions of the pixels and a change in the data signals.

20 Claims, 13 Drawing Sheets

POS1 [0:1]

POS2 [0:2]

DISPLAY DEVICE AND METHOD FOR DRIVING THE SAME

This application claims priority to Korean Patent Application No. 10-2020-0117971 filed on Sep. 14, 2020, and all the benefits accruing therefrom under 35 U.S.C. § 119, the content of which in its entirety is herein incorporated by reference.

BACKGROUND

1. Field

The present invention relates to an electronic device, and more particularly, to a display device.

2. Description of the Related Art

In general, a display device has a structure in which a scan driver is disposed at one side of a pixel unit and a data driver is disposed at the other side thereof. A structure of the display device for implementing a narrow bezel in which non-display areas on opposite sides of the display device are minimized has been under development. For example, in order to implement the narrow bezel, a panel having a single side driving structure in which the scan driver and the data driver are disposed at one side is being studied.

In a single side driving type display device, scan lines are formed to have different lengths. Due to such a line structure, the corresponding RC load non-uniformity occurs for each position of a pixel unit, and timings at which a scan signal and a data signal are supplied to each pixel are not synchronized. Thus, a deviation in a data charging rate occurs, resulting in a deterioration in display quality.

SUMMARY

An aspect of the present invention is to provide a display device that controls a slew rate of a data signal based on a change in a data signal and a position of a pixel of a display device having a single side driving structure.

Another aspect of the present invention is to provide a method for driving the display device.

It should be understood, however, that the aspect of the present invention may be not to be limited by the foregoing aspect, but may be variously expanded without departing from the spirit and scope of the present invention.

In order to achieve the aspect of the present invention, a display device according to embodiments of the present invention includes: a pixel unit including a plurality of pixels connected to data lines and scan lines and including signal output lines, where at least one signal output line of the signal output lines is connected to each of the scan lines through a contact point; a data driver disposed at one side of the pixel unit to drive the data lines; a scan driver disposed at the one side of the pixel unit together with the data driver to drive the scan lines; and a timing controller which controls the data driver and the scan driver. The data driver includes: output buffers which outputs data signals to the data lines, respectively; and a slew rate controller which adjusts a slew rate of the data signals by controlling a bias value supplied to the output buffers in units of pixel rows based on positions of the pixels in the pixel row and a change in the data signals.

According to an embodiment, the timing controller may sequentially supply a start-of-line packet, a line configuration packet, an image data packet, and a horizontal blank period packet to the data driver through a clock data line in units of pixel rows during an active data period of an image frame period, and the line configuration packet may include position information of the pixels.

According to an embodiment, the slew rate controller may include: a first weight determiner which determines a first weight using the position information included in the line configuration packet; a second weight determiner which determines a second weight based on a difference between a previous data signal and a current data signal, among the data signals, supplied to a corresponding data line among the data lines; and a bias controller which determines the bias value based on the first weight and the second weight and supplies a bias current corresponding to the bias value to the output buffers.

According to an embodiment, the line configuration packet may include a first position information field, a second position information field, and a third position information field which include the position information.

According to an embodiment, the first position information field may divide the pixel unit into a plurality of pixel blocks and may indicate one of the divided pixel blocks. The second position information field may divide each of the pixel blocks into a plurality of vertical blocks and may indicate one of the divided vertical blocks. The third position information field may divide each of the pixel blocks into a plurality of horizontal blocks and may indicate one of the divided horizontal blocks.

According to an embodiment, when a first data signal of the data signals is supplied to pixels of a previous pixel row among the plurality of pixels and then a second data signal is supplied to pixels of a current pixel row among the plurality of pixels, the bias current supplied to the output buffers may be different according to positions of the pixels of the current pixel row.

According to an embodiment, the first weight may be set based on a data charging rate according to a delay of a scan signal and a delay of the data signal for each target block of the pixel unit.

According to an embodiment, the second weight determiner may calculate a change amount and a transition direction from the previous data signal to the current data signal as the difference between the previous data signal and the current data signal.

According to an embodiment, the bias current may be different according to the transition direction under a condition of the same change amount in the data signal.

According to an embodiment, a first bias current that is the bias current determined when the transition direction is a positive direction may be larger than a second bias current that is the bias current determined when the transition direction is a negative direction.

According to an embodiment, each of the previous data signal and the current data signal may be an average value of data signals supplied to a selected point of the data line among the data signals.

According to an embodiment, in the same position condition in the pixel unit, a first bias current that is the bias current corresponding to the transition direction changing from a first gray scale to a second gray scale may be different from a second bias current that is the bias current corresponding to the transition direction changing from the second gray scale to the first gray scale.

According to an embodiment, when a voltage corresponding to the first gray scale is lower than a voltage corresponding to the second gray scale, the first bias current may be larger than the second bias current.

According to an embodiment, the pixel unit may include first to third pixel blocks that are continuous in a first direction. The at least one signal output line may include: first output lines connected to the scan lines in the first pixel block; second output lines connected to the scan lines in the second pixel block; and third output lines connected to the scan lines in the third pixel block.

According to an embodiment, the scan lines may extend in the first direction, and the first to third output lines may extend in a second direction crossing the first direction.

According to an embodiment, lengths of the first to third output lines in the pixel unit may gradually increase in the first direction.

In order to achieve the aspect of the present invention, a method for driving a display device according to embodiments of the present invention includes: supplying digital data to a data driver through a clock data line, the digital data including a line configuration packet and an image data packet; determining a first weight using pixel position information included in the line configuration packet; determining a second weight based on a difference between a previous data signal and a current data signal supplied to a data line; and adjusting a bias current based on the first weight and the second weight and supplying the adjusted bias current to output buffers of the data driver.

According to an embodiment, the line configuration packet may include: a first position information field which divides a pixel unit into a plurality of pixel blocks and indicates one of the divided pixel blocks; a second position information field which divides each of the pixel blocks into a plurality of vertical blocks and indicates one of the divided vertical blocks; and a third position information field which divides each of the pixel blocks into a plurality of horizontal blocks and indicates one of the divided horizontal blocks.

According to an embodiment, when a first data signal is supplied to pixels of a previous pixel row and then a second data signal is supplied to pixels of a current pixel row, the bias current supplied to the output buffers may be different according to positions of the pixels of the current pixel row.

According to an embodiment, the determining of the second weight may include calculating a change amount and a transition direction from the previous data signal to the current data signal. The bias current may be different according to the transition direction with respect to the same change amount in the data signal.

DETAILED DESCRIPTION

Figure 1:
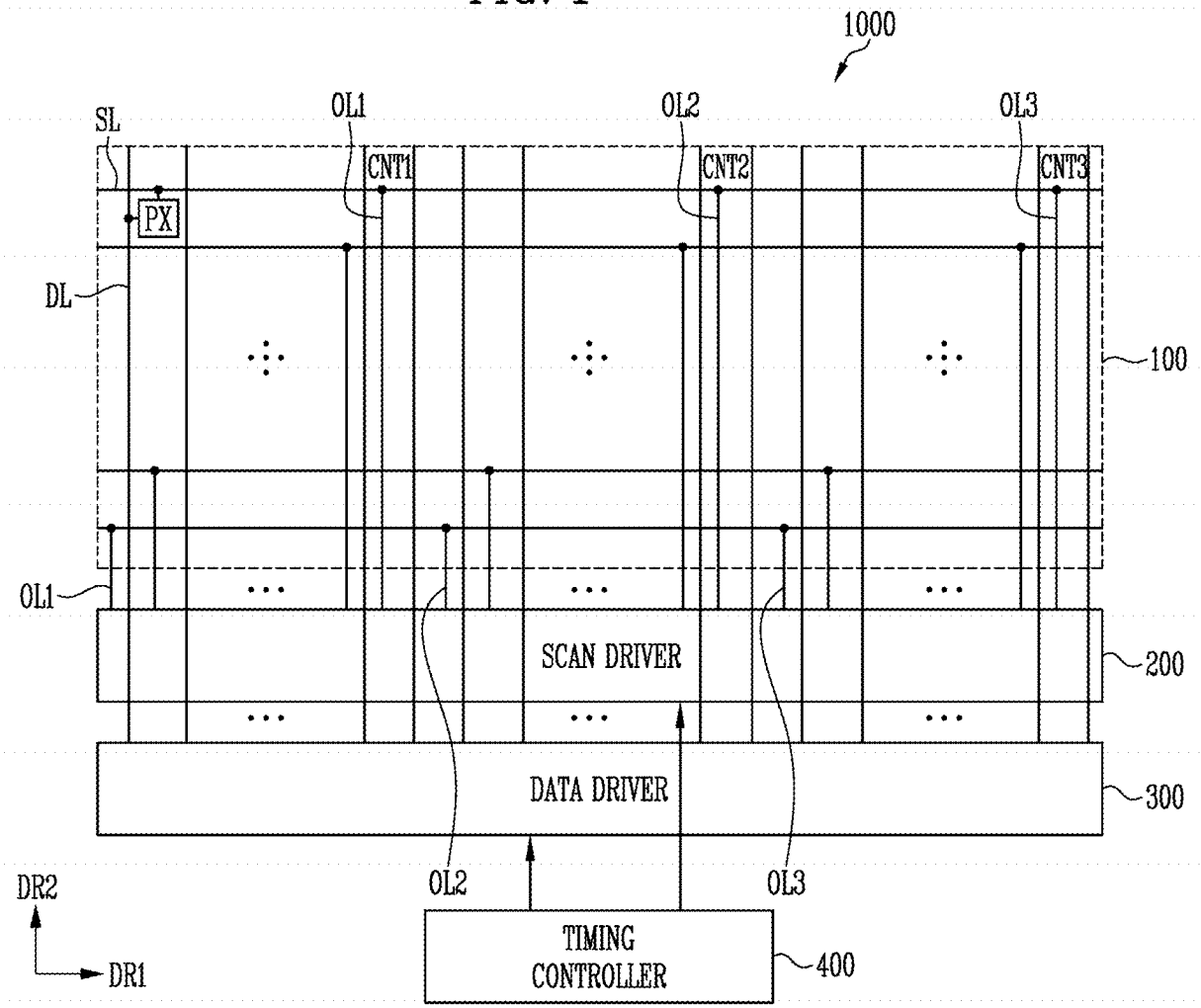
FIG. 1 is a block diagram illustrating a display device according to embodiments of the present invention.

Hereinafter, preferred embodiments of the present invention will be described in detail with reference to the accompanying drawings. The same reference numerals are used to denote the same elements in the drawings, and redundant descriptions of the same elements are omitted. It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

FIG. 1 is a block diagram illustrating a display device according to embodiments of the present invention.

Referring to FIG. 1, a display device 1000 may include a pixel unit 100 (i.e., display panel), a scan driver 200, a data driver 300, and a timing controller 400.

The display device 1000 may be implemented as a self-luminous display device including a plurality of self-luminous elements. For example, the display device 1000 may be an organic light emitting display device including organic light emitting elements, a display device including inorganic light emitting elements, or a display device including light emitting elements that include a combination of inorganic materials and organic materials. However, this is an example, and the display device 1000 may be implemented as a liquid crystal display, a plasma display device, a quantum dot display device, or the like.

The display device 1000 may be a flat display device, a flexible display device, a curved display device, a foldable display device, or a bendable display device. In addition, the display device may be applied to a transparent display device, a head-mounted display device, a wearable display device, or the like.

The pixel unit 100 may include a plurality of pixels PX connected to scan lines SL and data lines DL. The display device 1000 according to an embodiment is a display device 1000 having a single side driving structure in which the data driver 300 and the scan driver 200 are disposed together at one side of the pixel unit 100 as shown in FIG. 1. In an embodiment, in order to apply the single side driving, each of the scan lines SL may be connected to a first output line OL1, a second output line OL2, and a third output line OL3 at predetermined contact points CNT1, CNT2, and CNT3, respectively.

The pixel unit 100 may be divided into a first pixel block, a second pixel block, and a third pixel based on areas in which the first output line OL1, the second output line OL2, and the third output line OL3 are disposed. Although FIG. 1 illustrates that one scan line SL is connected to the three output lines OL1, OL2, and OL3, the present invention is not limited thereto.

The scan line SL may extend in a first direction DR1 (e.g., a pixel row direction or a horizontal direction) and may be connected to pixels PX of the corresponding pixel row. A scan signal may be supplied to the pixels PX through the scan line SL. That is, each of the scan lines SL may define the pixel row (i.e., pixels connected to the same scan line SL are the pixels in the same pixel row.).

The first output line OL1 may extend in a second direction DR2 and may be connected to the scan line SL at the first contact point CNT1. For example, the second direction DR2 may correspond to the pixel column direction. The first output line OL1 may electrically connect the scan driver 200 to the scan line SL.

In a case that a single output line is connected to the scan line SL, a deviation in resistor-capacitor ("RC") load (RC delay) between a point close to the contact point (e.g., CNT1) and a point far from the contact point (e.g., CNT2) may increase. In order to reduce the deviation in RC load, the scan line SL may be connected to the plurality of output lines OL1, OL2, and OL3 spaced apart from each other.

The second output line OL2 may extend in the second direction DR2 and may be connected to the scan line SL at the second contact point CNT2. The second output line OL2 may electrically connect the scan driver 200 to the scan line SL.

The third output line OL3 may extend in the second direction DR2 and may be connected to the scan line SL at the third contact point CNT3. The third output line OL3 may electrically connect the scan driver 200 to the scan line SL.

In an embodiment, each of the first to third output lines OL1, OL2, and OL3 may be connected to the scan lines SL in a one-to-one manner. That is, for example, one first output line OL1 may be connected to one scan line SL. As illustrated in FIG. 1, the first to third output lines OL1, OL2, and OL3 may be disposed so that their lengths in the second direction DR2 gradually increase in the first direction DR1.

The data lines DL may be connected to the pixels PX in units of pixel columns.

The scan driver 200 may receive a clock signal, a scan start signal, and the like from the timing controller 400 and supply the scan signal to the scan lines SL. For example, the scan driver 200 may sequentially supply, to the first output lines OL1, a first output signal for supplying the scan signal to the scan lines SL. The scan driver 200 may sequentially supply, to the second output lines OL2, a second output signal for supplying the scan signal to the scan lines SL. The scan driver 200 may sequentially supply, to the third output lines OL3, a third output signal for supplying the scan signal to the scan lines SL. As used herein, the first output lines OL1, second output lines OL2, third output lines OL3 may be collectively referred as "signal output lines".

The first to third output signals may be set to a gate-on level (as low voltage or high voltage) corresponding to the type of transistor to which the scan signal is supplied. That is, the first to third output signals may be generated and supplied as the scan signal. In order to drive the scan line SL, the first to third output signals may be substantially simultaneously supplied to the first to third output lines OL1, OL2, and OL3, respectively.

In an embodiment, the scan driver 200 may independently include a configuration for driving the first output lines OL1, a configuration for driving the second output lines OL2, and a configuration for driving the third output lines OL3.

The data driver 300 may generate a data signal based on image data supplied from the timing controller 400 and may supply the data signal to the data lines DL. The data driver 300 may apply analog data signals (i.e., data voltages) corresponding to image data of digital format to the data lines DL in units of pixel rows.

The timing controller 400 may receive input image data from an image source such as an external graphic device. The timing controller 400 may generate image data suitable for operating conditions of the pixel unit 100 based on the input image data and may provide the generated image data to the data driver 300.

Figure 2A:
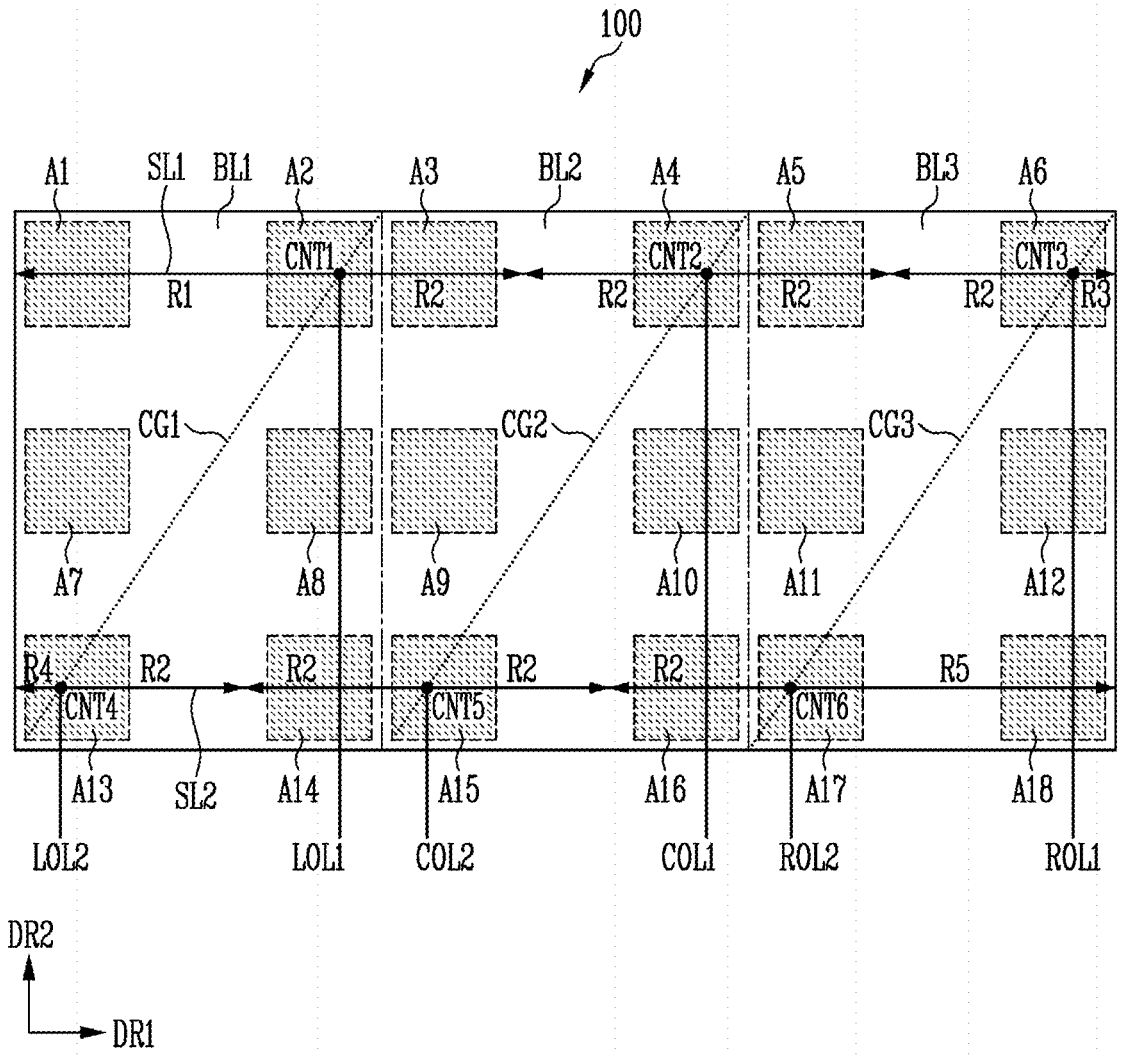
FIG. 2A is a diagram for describing an example of a pixel unit included in the display device of FIG. 1.
Figure 2B:
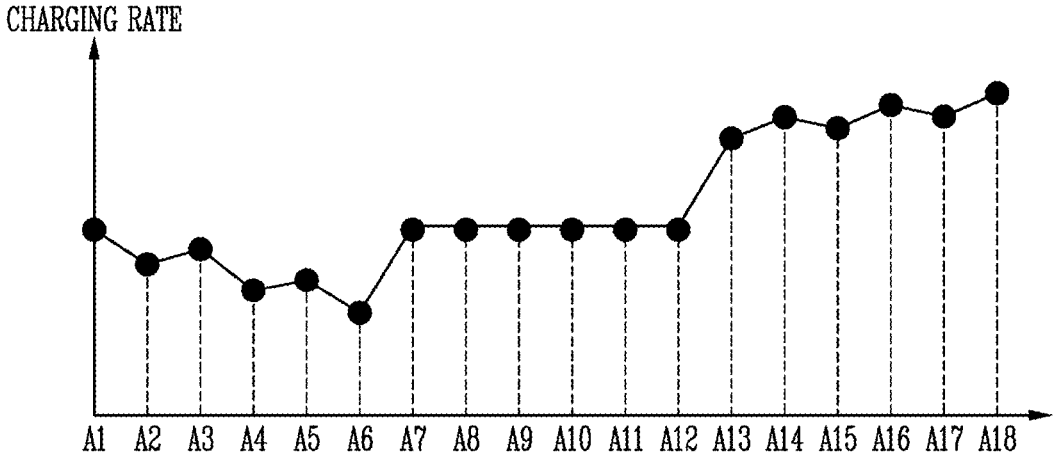
FIG. 2B is a diagram for describing an example of a deviation in charging rate for each position of the pixel unit of FIG. 2A.

FIG. 2A is a diagram for describing an example of the pixel unit included in the display device of FIG. 1, and FIG. 2B is a diagram for describing an example of a deviation in charging rate for each position of the pixel unit of FIG. 2A.

Referring to FIGS. 1 to 2B, the pixel unit 100 of the display device 1000 having the single side driving structure may be divided into a plurality of pixel blocks BL1, BL2, and BL3 according to the arrangement of output lines LOL1, LOL2, COL1, COL2, ROL1, and ROL2 and contact points CNT1 to CNT6.

The left output lines LOL1 and LOL2 (corresponding the first output lines OL1 in FIG. 1) may be disposed in the first pixel block BL1. The first left output line LOL1 may be connected to the first scan line SL1 through the first contact point CNT1. The second left output line LOL2 may be connected to the second scan line SL2 through the fourth contact point CNT4. The second scan line SL2 is disposed closer to the scan driver 200 and the data driver 300 compared to the first scan line SL1.

The left output lines LOL1 and LOL2 should not come in contact with each other or should not be electrically connected to each other. Therefore, the contact points CNT1 and CNT4 of the first pixel block BL1 may be disposed in a substantially diagonal, virtual line with respect to the first direction DR1. For example, as illustrated in FIG. 2A, the arrangement of the contact points CNT1 and CNT4 of the first pixel block BL1 may form a first contact point group CG1 in a diagonal shape with respect to the first direction DR1.

Similarly, the center output lines COL1 and COL2 (corresponding the second output lines OL2 in FIG. 1) may be disposed in the second pixel block BL2. The first center output line COL1 may be connected to the first scan line SL1 through the second contact point CNT2. The second center output line COL2 may be connected to the second scan line SL2 through the fifth contact point CNT5. The arrangement of the contact points CNT2 and CNT5 of the second pixel block BL2 may form a second contact point group CG2 in a diagonal shape with respect to the first direction DR1.

The right output lines ROL1 and ROL2 (corresponding the third output lines OL3 in FIG. 1) may be disposed in the third pixel block BL3. The first right output line ROL1 may be connected to the first scan line SL1 through the third contact point CNT3. The second right output line ROL2 may be connected to the second scan line SL2 through the sixth contact point CNT6. The arrangement of the contact points CNT3 and CNT6 of the third pixel block BL3 may form a third contact point group CG3 in a diagonal shape with respect to the first direction DR1.

In an embodiment, one pixel row may be defined by connecting a plurality of pixels PX to the same scan line. For example, the scan signal supplied to the pixels PX through the first scan line SL1 may be provided from the first left output line LOL1, the first center output line COL1, and the first right output line ROL1.

That is, in order to reduce the deviation in RC delay of the scan signal supplied to the pixels PX connected to the first scan line SL1, the scan signal may be substantially simultaneously supplied from the first left output line LOL1, the first center output line COL1, and the first right output line ROL1. Other scan lines and pixel rows may have similar configurations.

The RC delay of the output signal may increase as the length of the line for transmitting the signal increases. For example, the equivalent resistance (or equivalent impedance) of the first left output line LOL1 may include a first resistance component R1 to the left of the first contact point CNT1, and a second resistance component R2 to the right of the first contact point CNT1. Since a portion between the first contact point CNT1 and the second contact point CNT2 of the first scan line SL1 is affected by both the signal supplied from the first left output line LOL1 and the signal supplied from the first center output line COL1, it can be said that the resistance component (RC delay) of the middle portion between the first contact point CNT1 and the second contact point CNT2 is the greatest between the first contact point CNT1 and the second contact point CNT2.

Similarly, the equivalent resistance of the first center output line COL1 may include second resistance components R2 on both sides of the second contact point CNT2. The equivalent resistance of the first right output line ROL1 may include a second resistance component R2 to the left of the third contact point CNT3, and a third resistance component R3 to the right of the third contact point CNT3.

In this case, according to the length of the corresponding portion of the scan line, the first resistance component R1 may be the greatest and the third resistance component R3 may be the smallest.

Therefore, in the first scan line SL1, the RC delay of the scan signal in the first pixel block BL1 having the greatest influence of the first left output line LOL1 may be the greatest, and the RC delay of the scan signal in the third pixel block BL3 having the greatest influence of the first right output line ROL1 may be the smallest. That is, in predetermined scan lines at the upper end portion of the pixel unit 100 including the first scan line SL1, the RC delay of the scan signal may substantially decrease from the first pixel block BL1 to the third pixel block BL3. This trend may be maintained until the first resistance component R1 becomes smaller than the second resistance component R2.

In the data line DL extending in the second direction DR2, the RC delay of the data signal may increase in the second direction DR2 away from the data driver 300. The RC delay trend of the data signal with respect to the horizontal direction (e.g., the first direction DR1) may be substantially uniform.

Therefore, as illustrated in FIG. 2B, a data charging rate in a first area A1 for the same gray scale input (hereinafter, referred to as a data charging rate) may be greater than a data charging rate in a sixth area A6. For example, the RC delay of the data signal in the sixth area A6 may be the greatest, and the RC delay of the scan signal in the sixth area A6 among the first to sixth areas A1 to A6 may be the smallest by the position of the third contact point CNT3. Therefore, the data charging rate of the sixth area A6 may be the lowest in the entire pixel unit 100.

The data charging rates of the second area A2 and the third area A3, in which the RC delays of the scan signal are similar, may be similar to each other, and the data charging rates of the fourth area A4 and the fifth area A5 may be similar to each other.

Data charging rates of seventh to twelfth areas A7 to A12 included in the middle portion of the pixel unit 100, in which the RC delays of the scan signal in the horizontal direction is relatively uniform, may be similar to each other.

As described above, the second scan line SL2 may have a scan signal RC delay trend opposite to that of the first scan line SL1. In the second scan line SL2, the RC delay of the scan signal in the first pixel block BL1 may be the smallest among the first to third pixel blocks BL1 to BL3, and the RC delay of the scan signal in the third pixel block BL3 may be the greatest. That is, the RC delay of the scan signal may increase from the first pixel block BL1 to the third pixel block BL3.

Since the RC delay of the data signals supplied to the pixel row corresponding to the second scan line SL2 is much lower compared with the RC delay of the data signals supplied to the pixel row corresponding to the first scan line SL1, each of the data charging rates of thirteenth to eighteenth areas A13 to A18 may be higher than each of the data charging rates of the first to twelfth areas A1 to A12.

In other words, the data charging rate in the pixel unit 100 may be changed according to the positions of the contact points CNT1 to CNT18. Due to the deviation in the charging rate, image spots and the like may be visually recognized and image quality may be deteriorated.

The display device 1000 according to the embodiments of the present invention may control the slew rate of the data signal by adjusting the bias value (e.g., bias current or bias voltage) for controlling the output buffer of the data driver 300 in order to uniformly compensate the deviation in the charging rate according to the change in data signal and the position of the pixel in the single side driving structure.

Figure 3:
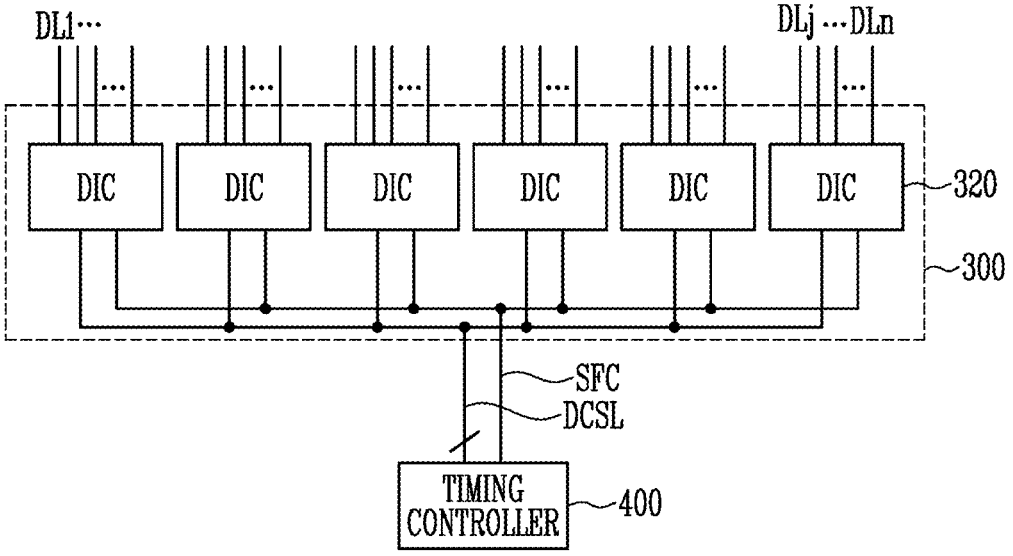
FIG. 3 is a block diagram illustrating an example of a data driver included in the display device of FIG. 1.

FIG. 3 is a block diagram illustrating an example of the data driver included in the display device of FIG. 1.

Referring to FIG. 3, the data driver 300 may include a plurality of driving ICs 320. When the data driver 300 includes the plurality of driving ICs 320, data lines DL1 to DLn may be grouped and each data line group may be connected to the corresponding driving IC 320.

The driving IC 320 may use one clock training line SFC as a common bus line. For example, the timing controller 400 may simultaneously transmit a notification signal indicating the supply of a clock training pattern to the entire driving ICs 320 through one clock training line SFC.

The driving IC 320 may be connected to the timing controller 400 through a dedicated clock data line DCSL. For example, the driving ICs 320 may be connected to the timing controller 400 through clock data lines DCSL, respectively.

At least one clock data line DCSL may be provided for each driving IC 320. For example, a plurality of clock data lines DCSL may be connected to each of the driving ICs 320 in order for compensation when a desired bandwidth of a transmission signal is not achieved with only one clock data line DCSL. In addition, even when the clock data line DCSL is configured with a differential signal line in order to cancel common mode noise, each of the driving ICs 320 may require a plurality of clock data lines DCSL.

Figure 4:
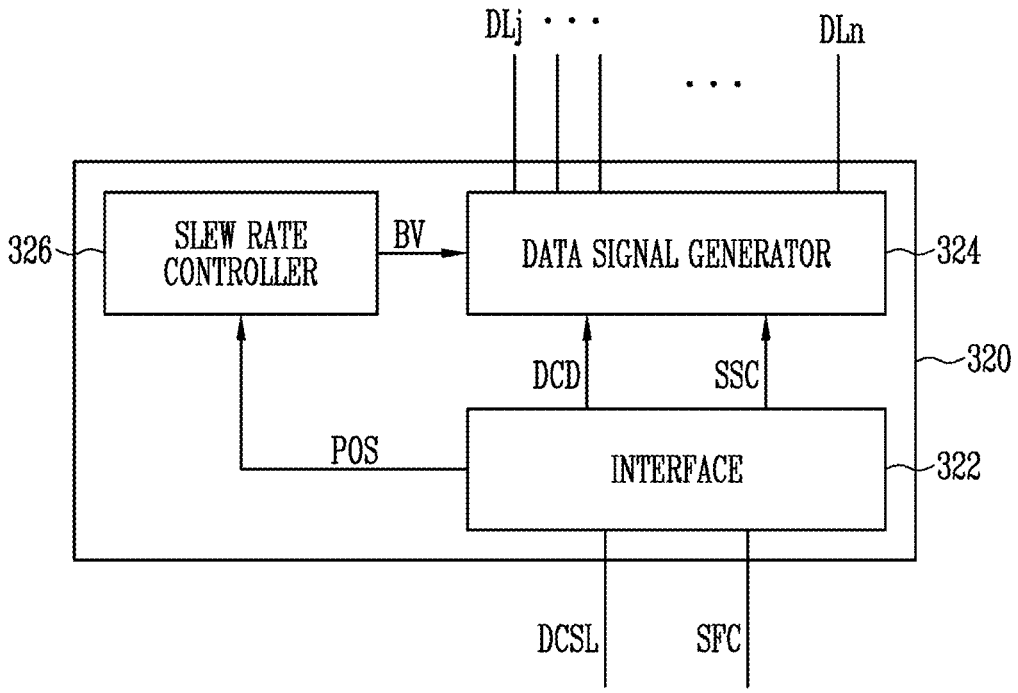
FIG. 4 is a block diagram illustrating an example of a driving IC included in the data driver of FIG. 3.

FIG. 4 is a block diagram illustrating an example of a driving IC included in the data driver of FIG. 3.

Referring to FIGS. 1, 3, and 4, the driving IC 320 may include an interface 322, a data signal generator 324, and a slew rate controller 326.

The interface 322 may receive the clock data signal from the timing controller 400 through the clock data line DCSL. The interface 322 may receive the clock training signal from the timing controller 400 through the clock training line SFC.

The interface 322 may conform to predetermined interface standards and DeFi standard. For example, the interface 322 that mediates data transmission and reception between the timing controller 400 and the driving IC 320 may be an intra panel interface of a Unified Standard Interface for TV ("USI-T"). However, this is an example and the format of the interface 322 according to the invention is not limited thereto.

The interface 322 may generate a clock signal using the clock training signal and the clock data signal, and may sample image data DCD from the clock data signal using the generated clock signal. The interface 322 may provide the sampled image data DCD to the data signal generator 324. In addition, the interface 322 may provide a source shift clock SSC to the data signal generator 324.

In an embodiment, the clock data signal may include a line configuration packet including position information of the pixels PX. The interface 322 may extract position information data POS from the line configuration packet. The position information data POS may be supplied to the slew rate controller 326.

The data signal generator 324 may receive the data signal DCD and the source shift clock SSC from the interface 322. The data signal generator 324 may generate data signals (i.e., data voltages) using the source shift clock SSC and the image data DCD.

The data signal generator 324 may apply data signals corresponding to grayscale values of pixels to the data lines DLj to DLn in synchronization with the period during which the scan signal of the turn-on level is applied to the scan line connected to the pixels. In an embodiment, the data signal generator 324 may include output buffers for outputting data signals converted from the image data DCD to each of the data lines DLj to DLn.

The slew rate controller 326 may receive the position information data POS of the pixels PX from the interface 322. The slew rate controller 326 may adjust the slew rate of the output data signal by controlling a bias value BV supplied to the output buffers in units of pixel rows based on the change in the data signal and the position information data POS.

In an embodiment, the change in the data signal may be a difference between an average of data signals supplied to the previous pixel row through the data lines DLj to DLn and an average of data signals supplied to the current pixel row. In this case, the bias value BV may be commonly applied to the output buffers corresponding to the data lines DLj to DLn.

In another embodiment, the change in the data signal may be a difference between the data signal of the previous pixel row of a portion of the data lines DLj to DLn or each of the data lines DLj to DLn and the data signal of the current pixel row. In this case, the bias value BV may be calculated and supplied in units of individual data lines or units of data line groups grouped into a predetermined group.

Figure 5:
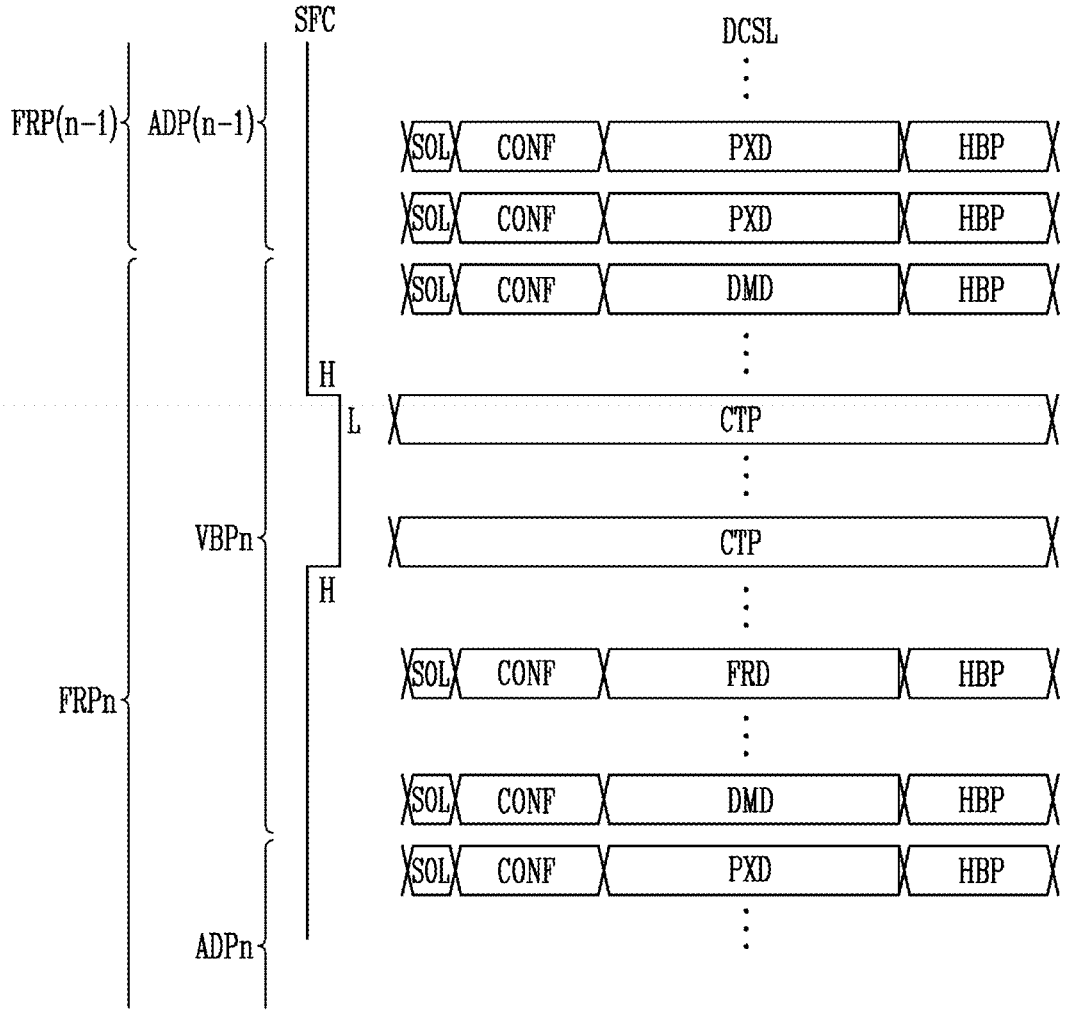
FIG. 5 is a diagram illustrating an example of signals supplied from a timing controller to a data driver.
Figure 6A:
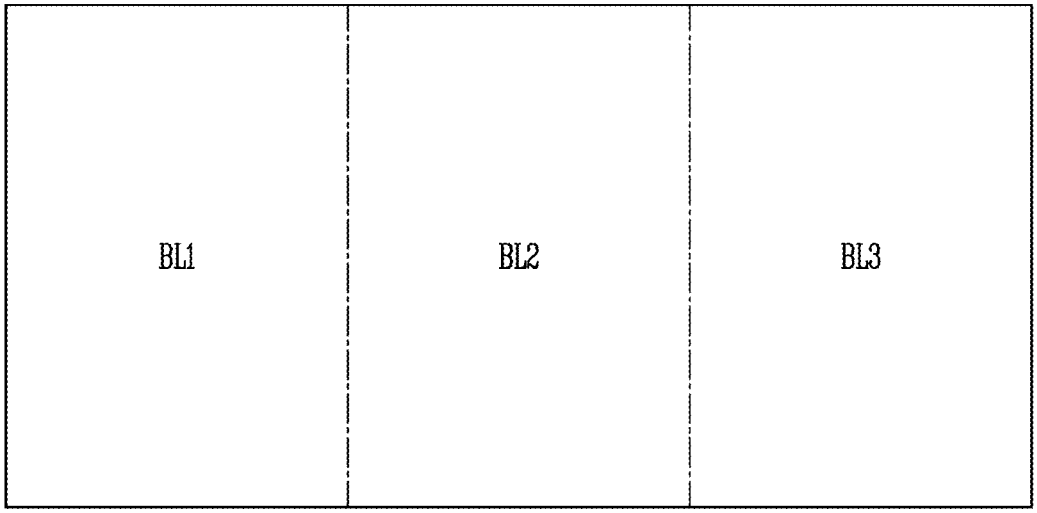
FIGS. 6A to 6C are diagrams for describing position information included in a line configuration packet of FIG. 5.
Figure 6B:
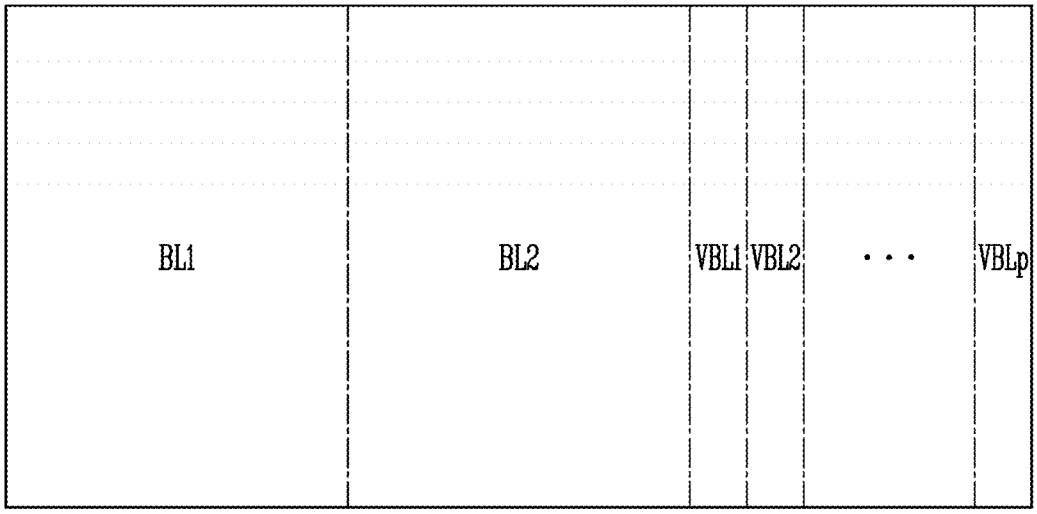
Figure 6C:
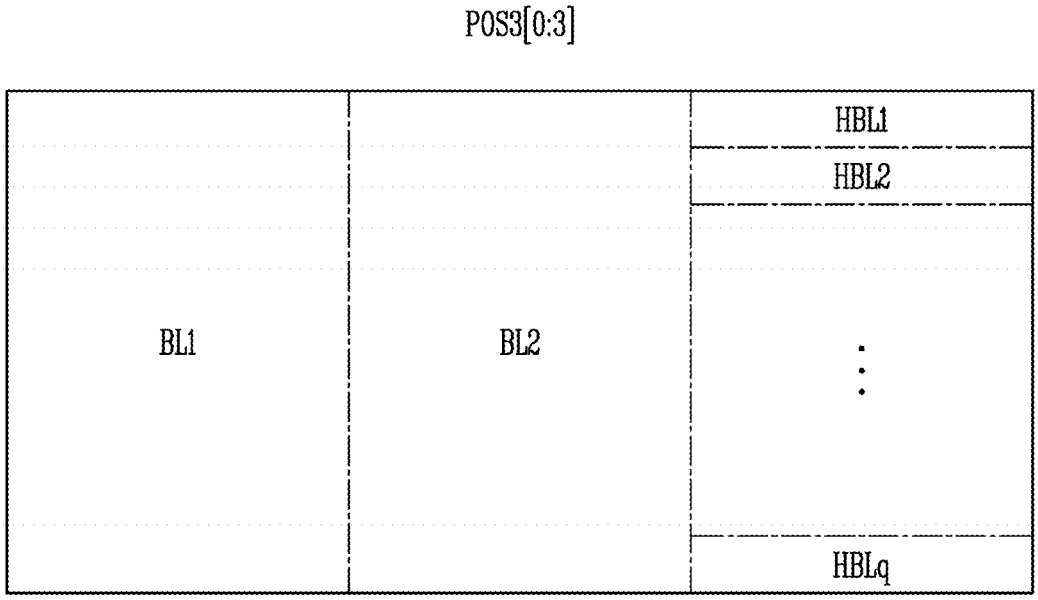

FIG. 5 is a diagram illustrating an example of the signals supplied from the timing controller to the data driver, and FIGS. 6A to 6C are diagrams for describing the position information included in the line configuration packet of FIG. 5.

Referring to FIGS. 4 to 6C, a frame period for each image frame may include a vertical blank period and an active data period. For example, an n-th frame period FRPn may include an n-th vertical blank period VBPn and an n-th active data period ADPn.

Each of the active data periods ADP(n−1) and ADPn may be a period for supplying gray scale values constituting an image frame to be displayed by the pixel unit 100. The gray scale values may be included in pixel data PXD (or image data).

The vertical blank period VBPn may be located between the active data period ADP(n−1) of the previous frame and the active data period ADPn of the current frame. Clock training, frame configuration, and dummy data supply may be performed during the vertical blank period VBPn. The vertical blank period VBPn may sequentially include a supply period of dummy data DMD, a supply period of clock training pattern CTP, a supply period of frame data FRD, and supply period of dummy data DMD.

The timing controller 400 may notify the data driver 300 that the clock training pattern CTP is being supplied to the clock data line DCSL by applying a clock training signal of a low logic level L to the clock training line SFC during the vertical blank period VBPn. When the clock training pattern CTP is not supplied, the timing controller 400 may apply a clock training signal of a high logic level H to the clock training line SFC.

During the active data periods ADP(n−1) and ADPn, a start-of-line packet SOL, a line configuration packet CONF, an image data packet (e.g., pixel data PXD, frame data FRD, or dummy data DMD), and a horizontal blank period packet HBP may be sequentially supplied in units of pixel rows.

The start-of-line packet SOL may notify the driving IC 320 that the supply of the signal to the changed pixel row is started.

The horizontal blank period packet HBP may notify the driving IC 320 that the pixel row corresponding to the image data packet such as the pixel data PXD (e.g., pixels connected to the same scan line) is changed.

The line configuration packet CONF may include an operation option of the driving IC 320. For example, the line configuration packet CONF may indicate that subsequent data is the pixel data PXD or the dummy data DMD.

The line configuration packet CONF may include position information of the pixels PX. In an embodiment, the line configuration packet CONF may include a first position information field POS1[0:1], a second position information field POS2[0:2], and a third position information field POS3[0:3].

As illustrated in FIG. 6A, the first position information field POS1[0:1] may divide the pixel unit 100 into a plurality of pixel blocks (e.g., the first to third pixel blocks BL1, BL2, and BL3 of FIG. 2A) and may indicate one of the divided pixel blocks. For example, the first position information field POS1[0:1] may be composed of 2 bits and may indicate one of the first to third pixel blocks BL1, BL2, and BL3.

As illustrated in FIG. 6B, the second position information field POS2[0:2] may divide each of the pixel blocks BL1, BL2, and BL3 into a plurality of vertical blocks VBL1 to VBLp (where p is an integer greater than 1) and indicate one of the divided vertical blocks VBL1 to VBLp. For example, the second position information field POS1[0:2] may be composed of 3 bits and may indicate one of eight vertical blocks VBL1 to VBLp. FIG. 6B illustrates an example in which the third pixel block BL3 indicated by the first position information field POS1[0:1] is divided by the second position information field POS2[0:2].

In an embodiment, each of the vertical blocks VBL1 to VBLp may correspond to the driving IC 320 of FIG. 3. For example, one of the vertical blocks VBL1 to VBLp may correspond to pixel columns that are driven by one driving IC 320. However, this is an example, and the pixel columns corresponding to the vertical blocks VBL1 to VBLp according to the invention are not limited thereto.

As illustrated in FIG. 6C, the third position information field POS3[0:3] may divide each of the pixel blocks BL1, BL2, and BL3 into a plurality of horizontal blocks HBL1 to HBLq (where q is an integer greater than 1) and may indicate one of the divided horizontal blocks HBL1 to HBLq. For example, the third position information field POS3[0:3] may be composed of 4 bits and may indicate one of ten or more horizontal blocks HBL1 to HBLq. FIG. 6C illustrates an example in which the third pixel block BL3 indicated by the first position information field POS1[0:1] is divided by the third position information field POS3[0:3].

The interface 322 may extract the position information data POS from the first position information field POS1[0:1], the second position information field POS2[0:2], and the third position information field POS3[0:3]. For example, as illustrated in FIGS. 6A to 6C, position information data POS of a predetermined target block matching all of the first position information field POS1[0:1], the second position information field POS2[0:2], and the third position information field POS3[0:3] may be generated from the interface 322.

The position information data POS may include position information data for i×j pixels PX (where i and j are natural numbers).

The slew rate controller 326 may output a first weight corresponding to the position information data POS.

In this manner, the display device 1000 may accurately provide the position information of the pixel unit 100 to the data driver 300 and the driving IC 320, without any additional physical circuit configuration, by applying bit information of the position information fields POS1[0:1], POS2[0:2], and POS3[0:3] to an unused (N/A) field of the line configuration packet CONF transmitted through the interface 322. Therefore, it is possible to easily control the slew rate of the data signal according to the positions of the pixel rows and the pixel columns inside the pixel unit 100 of the display device 1000 having the single side driving structure.

Figure 7:
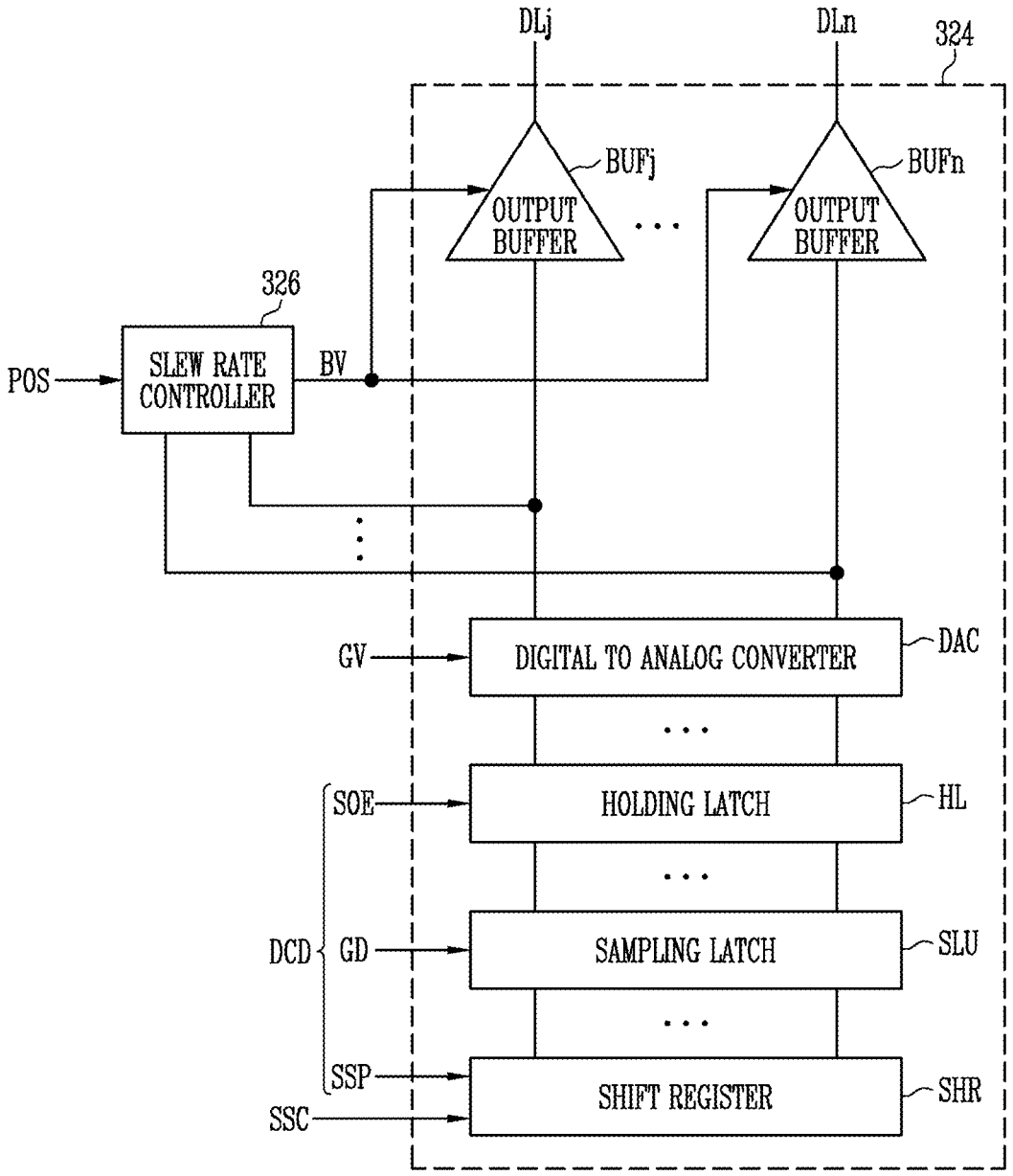
FIG. 7 is a block diagram illustrating an example of a data signal generator included in the driving IC of FIG. 4.

FIG. 7 is a block diagram illustrating an example of the data signal generator included in the driving IC of FIG. 4.

Referring to FIGS. 4 and 7, the data signal generator 324 may include a shift register SHR, a sampling latch SLU, a holding latch HL, a digital to analog converter DAC, and output buffers BUFj to BUFn (where j is a positive integer, and n is an integer greater than j).

The shift register SHR may sequentially generate sampling signals while shifting a source start pulse SSP every cycle of a source shift clock SSC. The number of sampling signals may correspond to the number of data lines DLj to DLn. For example, the number of sampling signals may be equal to the number of data lines DLj to DLn. As another example, when the display device 1000 further includes a demultiplexer between the data driver 300 and the data lines DLj to DLn, the number of sampling signals may be smaller than the number of data lines DLj to DLn.

The sampling latch SLU may include sampling latch units corresponding to the number of data lines DLj to DLn. The sampling latch SLU may sequentially receive gray scale values GD (e.g., image data) for an image frame from the timing controller 400. The sampling latch SLU may store the gray scale values GD sequentially received from the timing controller 400 in response to the sampling signals sequentially supplied from the shift register SHR.

The holding latch HL may include holding latch units corresponding to the number of data lines DLj to DLn. When a source output enable signal SOE is input, the holding latch HL may receive and store the gray scale values GD stored in the sampling latch.

The digital to analog converter DAC may include digital to analog conversion units corresponding to the number of data lines DLj to DLn. In the digital to analog converter DAC, each of the digital to analog conversion units may supply, to the corresponding output buffers BUFj to BUFn, the gray scale voltage GV (corresponding to the data signal) corresponding to the gray scale value GD stored in the corresponding holding latch HL.

In an embodiment, the output of the digital to analog converter DAC may also be supplied to the slew rate controller 326. The gray scale voltage GV supplied to the slew rate controller 326 may be understood as the data signal of the corresponding pixel row and the corresponding data line DL.

The gray scale voltage GV may be provided from a gray scale voltage generator (not illustrated). The gray scale voltage generator may include a red gray scale voltage generator, a green gray scale voltage generator, and a blue gray scale voltage generator. In this case, the gray scale voltage GV may be set so that the luminance corresponding to each gray scale follows a gamma curve.

The output buffers BUFj to BUFn may supply the outputs of the digital to analog converter DAC to the corresponding data lines DLj to DLn as the data signals, respectively. In an embodiment, each of the output buffers BUFj to BUFn may include an operational amplifier. For example, each of the output buffers BUFj to BUFn may be a buffer having a known current mode logic ("CML") structure or a complementary metal-oxide-semiconductor ("CMOS") structure. However, this is an example, and the structure of the output buffers BUFj to BUFn according to the invention is not limited thereto.

The slew rate of the outputs of the output buffers BUFj to BUFn may be controlled by the bias value BV supplied to the output buffers BUFj to BUFn. The bias value BV may refer to a bias current or a bias voltage, and may be generated and supplied in the form suitable for the type of the output buffers BUFj to BUFn.

Hereinafter, the present invention will be described on the assumption that the bias value BV is a bias current. However, the bias value BV may also be understood as a voltage value.

The slew rate controller 326 may control the magnitude of the bias value BV provided to the output buffers BUFj to BUFn. Although FIG. 7 illustrates that the bias value BV is commonly supplied to the output buffers BUFj to BUFn, the present invention is not limited thereto.

In an embodiment, for example, the slew rate controller 326 may divide the output buffers BUFj to BUFn into a plurality of groups and separately generate the bias value BV for each group. Each group may correspond to one or more output buffers.

Figure 8:
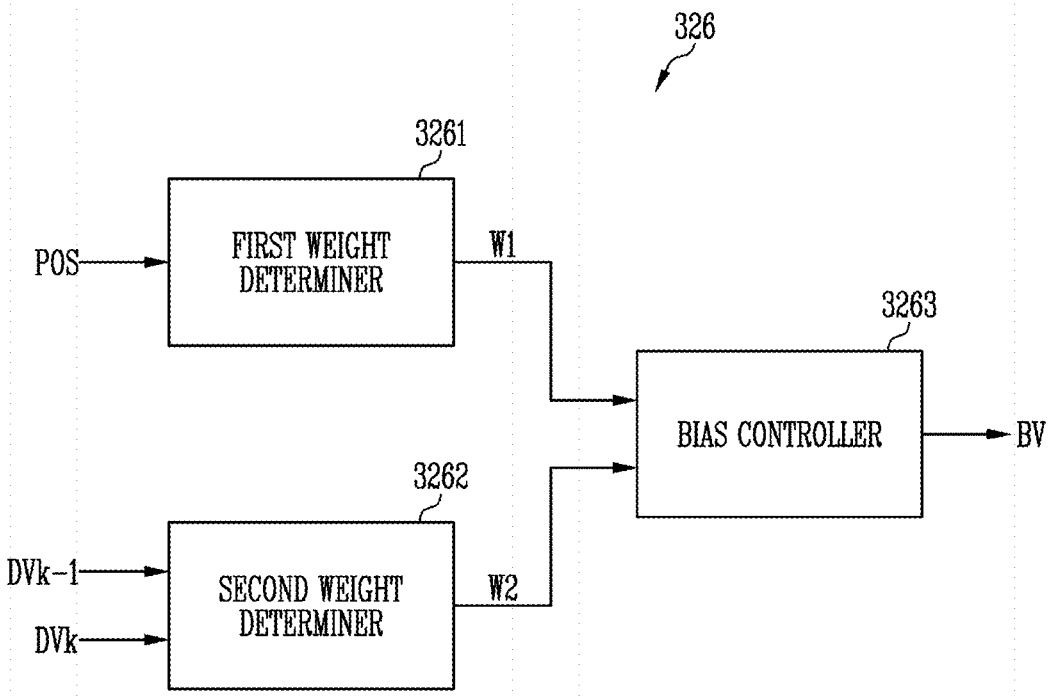
FIG. 8 is a block diagram illustrating an example of a slew rate controller included in the driving IC of FIG. 4.

FIG. 8 is a block diagram illustrating an example of the slew rate controller included in the driving IC of FIG. 4.

Referring to FIGS. 2A, 2B, 4, 5, 7, and 8, the slew rate controller 326 may include a first weight determiner 3261, a second weight determiner 3262, and a bias controller 3263.

The first weight determiner 3261 may determine a first weight W1 using the position information data POS derived from the line configuration packet CONF. The position information data POS may divide the pixel unit 100 into a plurality of target blocks and may indicate one of the target blocks. For example, the target blocks may be determined based on the areas A1 to A18 illustrated in FIGS. 2A and 2B.

The first weight W1 may be determined based on the data charging rate for each target block. The first weight W1 corresponding to an area having a relatively great data charging rate may have a relatively small value, and the first weight W1 corresponding to an area having a relatively small data charging rate may have a relatively great value.

In an embodiment, for example, the first weight W1 applied to a predetermined target block included in the sixth area A6 of FIGS. 2A and 2B may be greater than each of the first weights W1 applied to target blocks included in the remaining areas. In addition, the first weights W1 of target blocks included in the seventh to twelfth areas A7 to A12 may be substantially identical to each other.

The first weight W1 may control the bias value BV. For example, as the first weight W1 increases, the bias value BV may increase. When the bias value BV is great, the slew rate of the output signal (i.e., the data signal) of the output buffer may be great. As the bias value BV decreases, the slew rate of the data signal may decrease.

In an embodiment, when the first data signal is supplied to the pixels of the previous pixel row and then the second data signal is supplied to the pixels of the current pixel row (i.e., under the same gray scale change condition), the bias value BV supplied to the output buffers may be different according to the positions of the pixels with respect to the current pixel row. For example, in the pixels corresponding to the first scan line SL1, the bias value BV supplied to the output buffers corresponding to the pixels included in the first area A1 may be smaller than the bias value BV supplied to the output buffers corresponding to the pixels included in the sixth area A6.

In addition, under the same gray scale change (i.e., the change in the data signal), the slew rate of the data signal output from the eighteenth area A18 may be smaller than the slew rate when the first weight W1 is not reflected. In other words, in a portion in which the data charging rate is sufficient, the slew rate of the data signal may be lowered by the first weight W1 and the power consumption may be effectively reduced.

Under the same gray scale change (i.e., the change in the data signal), the slew rate of the data signal output from the sixth area A6 may be greater than the slew rate when the first weight W1 is not reflected. Therefore, the insufficient data charging rate in the sixth area A6 may be effectively compensated.

The second weight determiner 3262 may determine the second weight W2 based on a difference between a previous data signal DVk−1 (where k is a natural number) and a current data signal DVk supplied to a corresponding data line. The previous data signal DVk−1 may be a data signal supplied to a corresponding pixel of a previous pixel row (e.g., a (k−1)-th pixel row), and the current data signal DVk may be a data signal supplied to a corresponding pixel of a current pixel row (e.g., a k-th pixel row). In this case, a 0-th data signal DV0 may be a dummy data signal.

The previous data signal DVk−1 and the current data signal DVk may correspond to one data line. However, as illustrated in FIG. 7, when the bias value BV is commonly provided to the data lines DLj to DLn, the previous data signal DVk−1 may be an average value (or a median value) of data signals supplied to the previous pixel row through the data lines DLj to DLn, and the current data signal DVk may be an average value (or a median value) of data signals supplied to the current pixel row through the data lines DLj to DLn.

The difference between the previous data signal DVk−1 and the current data signal DVk may include a transition direction and a change amount from the previous data signal DVk−1 to the current data signal DVk. The change amount may be an absolute value of the change amount of the voltage level of the data signal. As the change amount increases, the second weight W2 and the bias value BV may increase.

In an embodiment, when the voltage level increases, the transition direction may be determined as a positive direction. When the voltage level decreases, the transition direction may be determined in a negative direction.

However, this is an example, and the change amount and the transition direction may be calculated based on the gray scale value of the digital format.

In an embodiment, the second weight W2 and the bias value BV may be different according to the transition direction under the condition of the same change amount of the data signal. This is because the change amount of the gate-source voltage changes according to the voltage change direction due to the characteristics of the transistors included in the pixel. For example, the second weight W2 and the first bias value (e.g., the first bias current) determined when the data signal transitions in the positive direction may be larger than the second weight W2 and the second bias value (i.e., the second bias current) determined when the data signal transitions in the negative direction.

The bias controller 3263 may determine the bias value BV based on the first weight W1 and the second weight W2. The bias controller 3263 may supply the bias current corresponding to the bias value BV to the output buffers BUFj to BUFn.

As described above, the display device 1000 having the single side driving structure according to the embodiments of the present invention may control the bias value BV (e.g., the bias current) supplied to the output buffers BUFj to BUFn of the data driver 300, based the positions of pixels associated with the contact points and the change (i.e., gray scale change) in the data signal between the adjacent pixel rows. Therefore, the slew rate of the data signals is adaptively controlled according to the positions of the pixels and the gray scale change between the adjacent pixel rows, thereby improving the deviation in the data charging rate of the pixel unit 100. Therefore, the image quality of the display device 1000 having the single side driving structure may be substantially improved.

In addition, the bias value BV and the data slew rate are reduced in a region in which the data charging rate is sufficient, thereby reducing power consumption.

Furthermore, since pixel position information is transmitted through the line configuration packet CONF of the interface 322 connected to the timing controller 400, position detection may be performed without adding costs and complicated physical circuit configurations. Therefore, it is possible to easily control the slew rate of the data signal according to the positions of the pixel rows and the pixel columns inside the pixel unit 100 of the display device 1000 having the single side driving structure.

Figure 9:
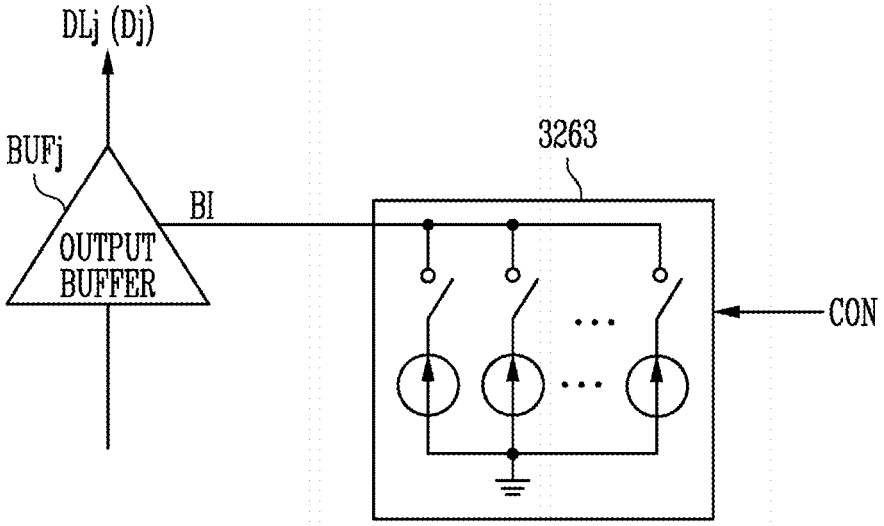
FIG. 9 is a diagram illustrating an example of a partial configuration of a bias controller of FIG. 8.

FIG. 9 is a diagram illustrating an example of a partial configuration of the bias controller of FIG. 8.

Referring to FIGS. 7, 8, and 9, the bias controller 3263 may output the bias current BI based on the first weight W1 and the second weight W2.

However, this is an example, and the bias value may also be controlled in the voltage domain.

In an embodiment, the bias controller 3263 may include a plurality of current sources connected in parallel, and a plurality of switches for controlling the connection thereof. The bias controller 3263 may generate a control signal CON for controlling the switches based on the first weight W1 and the second weight W2. The operations of the switches may be individually controlled by the control signal CON.

In an embodiment, for example, in order to increase the slew rate of the data signal Dj as the charging rate of the data signal Dj for the pixel decreases, the bias current BI may be increased by increasing the number of switches that are turned on in response to the data signal Dj.

The j-th output buffer BUFj may adjust the slew rate of the data signal Dj supplied to the j-th data line DLj based on the bias current BI.

Figure 10:
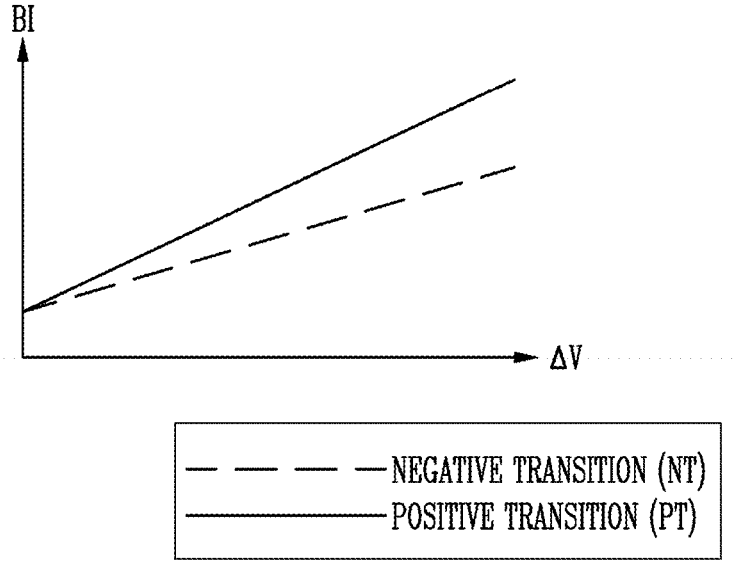
FIG. 10 is a diagram illustrating an example of a bias current determined according to a change in a data signal.

FIG. 10 is a diagram illustrating an example of the bias current determined according to the change in the data signal.

Referring to FIGS. 8 and 10, the bias current BI and the slew rate of the output of the current data signal DVk may be adjusted according to the difference between the previous data signal DVk−1 and the current data signal DVk in the target pixel or the target block.

A voltage change amount (ΔV), which is the change amount between the previous data signal DVk−1 and the current data signal DVk, may be an absolute value of a voltage difference. As the voltage change amount (ΔV) increases, the data signal has to be rapidly shifted. Therefore, the bias current BI may increase.

In addition, as described above, the bias current BI corresponding to the positive direction transition ("PT") of the data signal may be larger than the bias current BI corresponding to the negative direction transition ("NT") of the data signal. For example, the bias current BI when transitioning from the previous data signal DVk−1 of 1 voltage (V) to the current data signal DVk of 3V may be larger than the bias current BI when transitioning from the previous data signal DVk−1 of 3V to the current data signal DVk of 1 V.

Figure 11A:
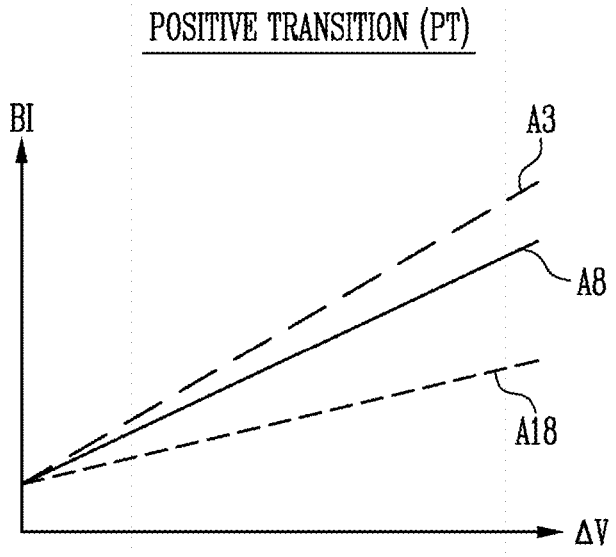
FIGS. 11A and 11B are diagrams illustrating examples of a bias current determined according an area of a pixel unit and a change in a data signal.
Figure 11B:
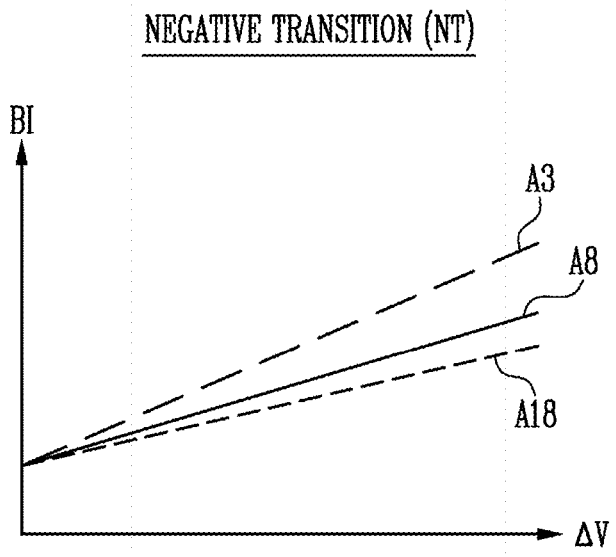

FIGS. 11A and 11B are diagrams illustrating an example of the bias current determined according the area of the pixel unit and the change in the data signal.

Referring to FIGS. 2A, 2B, 8, 10, 11A, and 11B, the bias current BI and the slew rate of the output of the current data signal DVk may be adjusted according to the target block (or target area) of the pixel unit 100, the voltage change amount (ΔV), and the transition direction of the data signal (e.g., PT or NT).

In FIGS. 11A and 11B, the same reference numerals are used for the elements described above with reference to FIG. 10, and redundant descriptions of these elements will be omitted.

FIGS. 11A and 11B typically show the second weights W2 corresponding to the third area A3, the eighth area A8, and the eighteenth area A18. As described above, the data charging rate of the third area A3 may be smaller than the data charging rate of the eighth area A8, and the data charging rate of the eighth area A8 may be lower than the data charging rate of the eighteenth area A18.

FIG. 11A illustrates the change of the second weight W2 in the positive direction transition (PT) condition of the data signal, and FIG. 11B illustrates the change of the second weight W2 in the negative direction transition (NT) condition of the data signal.

In an embodiment, when the voltage change amount (ΔV) is 0, there is no change in the data signal itself, and thus, the bias current BI may be the same, regardless of the position of the target block.

As illustrated in FIG. 11A, under the same voltage change (ΔV) conditions except for the case in which the voltage change amount (ΔV) is 0, the bias current BI corresponding to the area having a low data charging rate (e.g., the third area A3) may be larger than the bias current BI corresponding to the area having a high data charging rate (e.g., the eighteenth area A18). Therefore, the deviation in data charging rates for all areas and target blocks may be substantially improved.

As illustrated in FIG. 11B, under the same target block and voltage change amount (ΔV) conditions, the bias current BI when the change in the data signal is the negative direction transition (NT) may be smaller than the bias current BI when the change in the data signal is the positive direction transition (PT). As such, by lowering the bias current BI in the case of the negative direction transition (NT), the data charging rate may be substantially improved and the power consumption may be effectively reduced.

Figure 12:
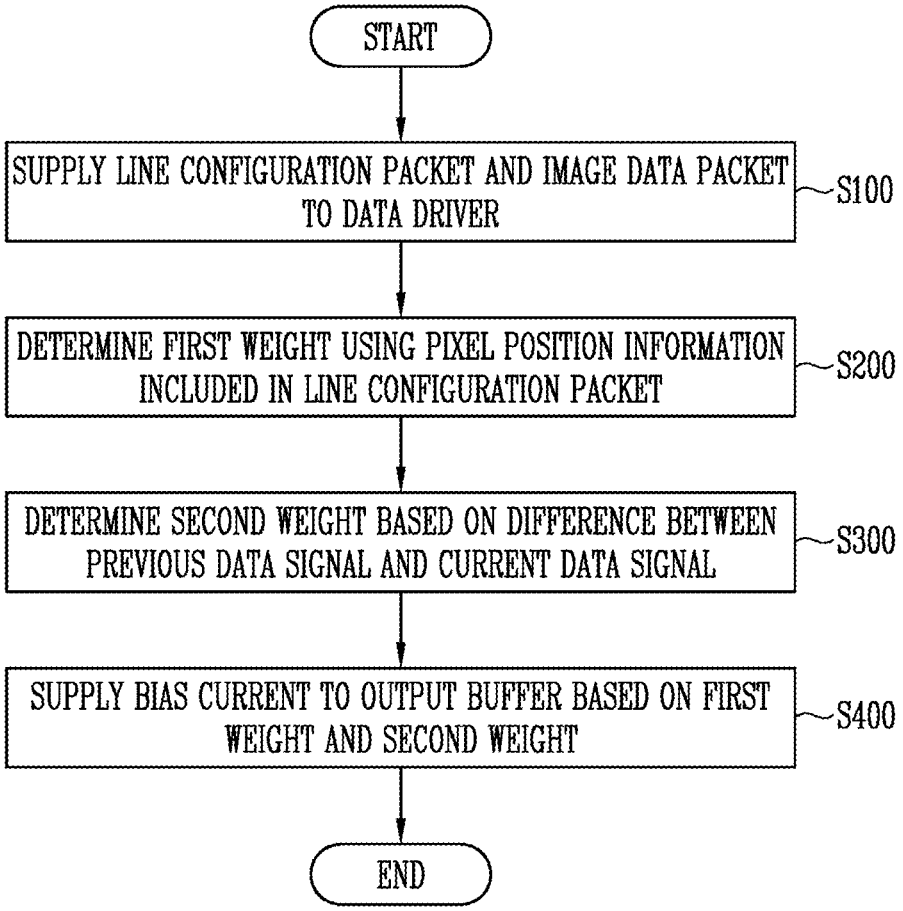
FIG. 12 is a flowchart illustrating a method for driving a display device, according to embodiments of the present invention.

FIG. 12 is a flowchart illustrating a method for driving a display device, according to embodiments of the present invention.

Referring to FIG. 12, the method for driving the display device may include: supplying digital data including a line configuration packet and an image data packet to a data driver through a clock data line (S100); determining a first weight using pixel position information included in the line configuration packet (S200); determining a second weight based on a difference between a previous data signal and a current data signal supplied to a data line (S300); and adjusting a bias current based on the first weight and the second weight and supplying the adjusted bias current to output buffers of the data driver (S400).

In an embodiment, the line configuration packet may include the first to third position information fields described above. Under a condition that the change in the data signal is the same, bias currents supplied to the output buffers may be different according to positions of pixels of the same pixel row. In addition, under the same pixel condition, the bias current may be controlled according to the change amount and the transition direction from the previous data signal to the current data signal.

However, in the method for driving the display device, since operations S100 to S400 have been described above in detail with reference to FIGS. 1 to 11B, redundant descriptions will be omitted.

As described above, the display device and the method for driving the same according to embodiments of the present invention may control the bias value (e.g., the bias current) supplied to the output buffers of the data driver, based the positions of pixels associated with the contact points of the pixel unit of the single side driving structure and the change (i.e., gray scale change) in the data signal between the adjacent pixel rows. Therefore, the slew rate of the data signals is adaptively controlled according to the positions of the pixels and the gray scale change between the adjacent pixel rows, thereby improving the deviation in the data charging rate of the pixel unit. Therefore, the image quality of the display device having the single side driving structure may be substantially improved.

In addition, the bias value and the data slew rate are effectively reduced in a region in which the data charging rate is sufficient, thereby reducing power consumption.

Furthermore, since pixel position information is transmitted through the line configuration packet of the interface connected to the timing controller, position detection may be performed without adding costs and complicated physical circuit configurations. Therefore, it is possible to easily control the slew rate of the data signal according to the positions of the pixel rows and the pixel columns inside the pixel unit of the display device having the single side driving structure.

The display device and the method for driving the same according to embodiments of the present invention may control the bias value (e.g., the bias current) supplied to the output buffers of the data driver, based the positions of pixels associated with the contact points of the pixel unit of the single side driving structure and the change (i.e., gray scale change) in the data signal between the adjacent pixel rows. Accordingly, the slew rate of the data signals is adaptively controlled according to the positions of the pixels and the gray scale change between the adjacent pixel rows, thereby improving the deviation in the data charging rate of the pixel unit. Therefore, the image quality of the display device having the single side driving structure may be substantially improved.

In addition, the bias value and the data slew rate are reduced in a region in which the data charging rate is sufficient, thereby reducing power consumption.

Furthermore, since pixel position information is transmitted through the line configuration packet of the interface connected to the timing controller, position detection may be performed without adding costs and complicated physical circuit configurations. Therefore, it is possible to easily control the slew rate of the data signal according to the positions of the pixel rows and the pixel columns inside the pixel unit of the display device having the single side driving structure.

It should be understood, however, that the effect of the present invention may be not to be limited by the foregoing effect, but may be variously expanded without departing from the spirit and scope of the present invention.

Although the present invention has been described above with reference to embodiments, those with ordinary skill in the technical field to which the present invention pertains will understood that various modifications and changes can be made to the present invention without departing from the spirit and scope of the present invention set forth in the appended claims.

What is claimed is:

1. A display device comprising:

a pixel unit including a plurality of pixels connected to data lines and scan lines and including signal output lines, wherein at least one signal output line of the signal output lines is connected to each of the scan lines through a contact point;

a data driver disposed at one side of the pixel unit to drive the data lines;

a scan driver disposed at the one side of the pixel unit together with the data driver and electrically connected to the scan lines through the signal output lines to the scan to drive the scan lines; and a timing controller which controls the data driver and the scan driver, wherein the data driver comprises:

output buffers which output data signals to the data lines, respectively; and a slew rate controller which adjusts a slew rate of the data signals by controlling a bias value supplied to the output buffers in units of pixel rows based on positions of the pixels in the pixel row and a change in the data signals.

2. The display device of claim 1, wherein the timing controller sequentially supplies a start-of-line packet, a line configuration packet, an image data packet, and a horizontal blank period packet to the data driver through a clock data line in units of pixel rows during an active data period of an image frame period, and the line configuration packet includes position information of the pixels.

3. The display device of claim 2, wherein the slew rate controller comprises:

a first weight determiner which determines a first weight using the position information included in the line configuration packet;

a second weight determiner which determines a second weight based on a difference between a previous data signal and a current data signal, among the data signals, supplied to a corresponding data line among the data lines; and a bias controller which determines the bias value based on the first weight and the second weight and supplies a bias current corresponding to the bias value to the output buffers.

4. The display device of claim 3, wherein the line configuration packet includes a first position information field, a second position information field, and a third position information field which include the position information.

5. The display device of claim 4, wherein the first position information field divides the pixel unit into a plurality of pixel blocks and indicates one of the divided pixel blocks, the second position information field divides each of the pixel blocks into a plurality of vertical blocks and indicates one of the divided vertical blocks, and the third position information field divides each of the pixel blocks into a plurality of horizontal blocks and indicates one of the divided horizontal blocks.

6. The display device of claim 3, wherein, when a first data signal of the data signals is supplied to pixels of a previous pixel row among the plurality of pixels and then a second data signal of the data signals is supplied to pixels of a current pixel row among the plurality of pixels, the bias current supplied to the output buffers is different according to positions of the pixels of the current pixel row.

7. The display device of claim 3, wherein the first weight is set based on a data charging rate according to a delay of a scan signal and a delay of the data signal for each target block of the pixel unit.

8. The display device of claim 3, wherein the second weight determiner calculates a change amount and a transition direction from the previous data signal to the current data signal as the difference between the previous data signal and the current data signal.

9. The display device of claim 8, wherein the bias current is different according to the transition direction under a condition of a same change amount in the data signal.

10. The display device of claim 9, wherein a first bias current that is the bias current determined when the transition direction is a positive direction is larger than a second bias current that is the bias current determined when the transition direction is a negative direction.

11. The display device of claim 8, wherein each of the previous data signal and the current data signal is an average value of data signals supplied to a selected point of the data line among the data signals.

12. The display device of claim 8, wherein, in a same position condition in the pixel unit, a first bias current that is the bias current corresponding to the transition direction changing from a first gray scale to a second gray scale is different from a second bias current that is the bias current corresponding to the transition direction changing from the second gray scale to the first gray scale.

13. The display device of claim 12, wherein, when a voltage corresponding to the first gray scale is lower than a voltage corresponding to the second gray scale, the first bias current is larger than the second bias current.

14. The display device of claim 3, wherein the pixel unit includes first to third pixel blocks that are continuous in a first direction, and the at least one signal output line includes:

first output lines connected to the scan lines in the first pixel block, respectively;

second output lines connected to the scan lines in the second pixel block, respectively; and third output lines connected to the scan lines in the third pixel block, respectively.

15. The display device of claim 14, wherein the scan lines extend in the first direction, and the first to third output lines extend in a second direction crossing the first direction.

16. The display device of claim 15, wherein lengths of the first to third output lines in the pixel unit gradually increase in the first direction.

17. A method for driving a display device, the method comprising:

supplying digital data to a data driver through a clock data line, the digital data including a line configuration packet and an image data packet;

determining a first weight using pixel position information included in the line configuration packet;

determining a second weight based on a difference between a previous data signal and a current data signal supplied to a data line; and adjusting a bias current based on the first weight and the second weight and supplying the adjusted bias current to output buffers of the data driver.

18. The method of claim 17, wherein the line configuration packet includes:

a first position information field which divides a pixel unit into a plurality of pixel blocks and indicates one of the divided pixel blocks;

a second position information field which divides each of the pixel blocks into a plurality of vertical blocks and indicates one of the divided vertical blocks; and a third position information field which divides each of the pixel blocks into a plurality of horizontal blocks and indicates one of the divided horizontal blocks.

19. The method of claim 17, wherein, when a first data signal is supplied to pixels of a previous pixel row and then a second data signal is supplied to pixels of a current pixel row, the bias current supplied to the output buffers is different according to positions of the pixels of the current pixel row.

20. The method of claim 19, wherein the determining of the second weight includes calculating a change amount and a transition direction from the previous data signal to the current data signal, and the bias current is different according to the transition direction with respect to a same change amount in the data signal.

* * * * *